United States Patent [19]

Watkins

[11] 4,160,484

[45] Jul. 10, 1979

[54] SURFACE CONTROL WELL SAFETY VALVE

[75] Inventor: Fred E. Watkins, Houston, Tex.

[73] Assignee: Camco, Incorporated, Houston, Tex.

[21] Appl. No.: 869,556

[22] Filed: Jan. 16, 1978

[51] Int. Cl.[2] ..... E21B 43/12

[52] U.S. Cl. ..... 166/317; 166/323; 166/332; 251/79

[58] Field of Search ..... 251/79, 81; 166/317, 166/321, 322, 323, 332, 334; 137/498, 460, 68 R

[56] References Cited

U.S. PATENT DOCUMENTS

| | | | |
|---|---|---|---|
| 3,750,700 | 8/1973 | Ecuer | 137/498 |
| 3,778,027 | 12/1973 | Collins et al. | 251/81 |
| 3,850,194 | 11/1974 | Brown | 166/334 |
| 3,981,358 | 9/1976 | Watkins et al. | 251/79 X |
| 4,077,473 | 3/1978 | Watkins | 166/323 |

*Primary Examiner*—William Pate, III

*Attorney, Agent, or Firm*—Fulbright & Jaworski

[57] ABSTRACT

A well safety valve for controlling the fluid flow through a well tubing in which the valve is biased closed. When fluid control pressure is supplied from the well surface, the valve is opened, but the valve closes when the control pressure exceeds a predetermined value. The tubular member controlling the actuation of the valve member includes a first upper and a second lower telescoping section with releasable locking means normally securing the telescoping sections together. A stop shoulder is positioned in the path of movement of the second section in the opening direction for actuating the release of the locking means when the control fluid force exceeds said predetermined value, and the second telescoping section is moved in a closing direction for closing the valve member when the locking means is released. The locking means may be either a shear pin or a resettable lock.

9 Claims, 6 Drawing Figures

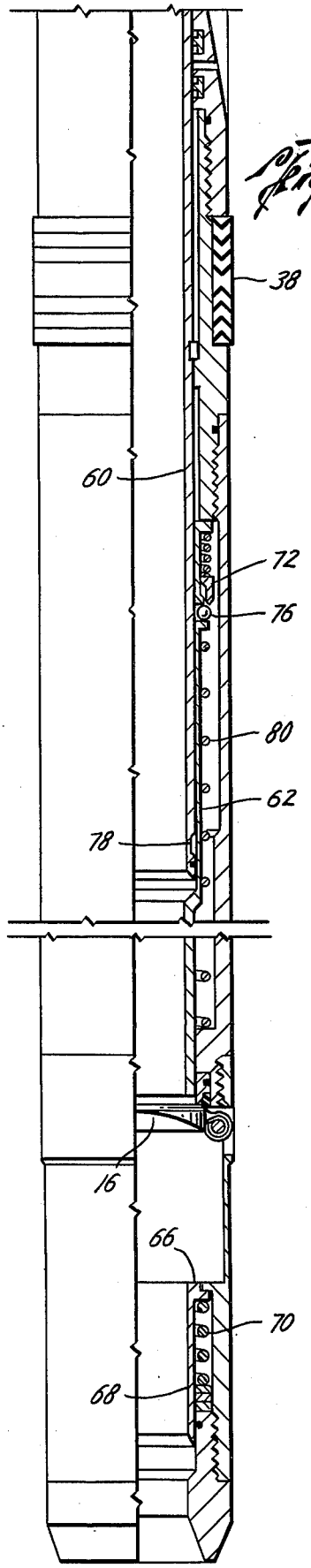
Fig. 3
Fig. 4
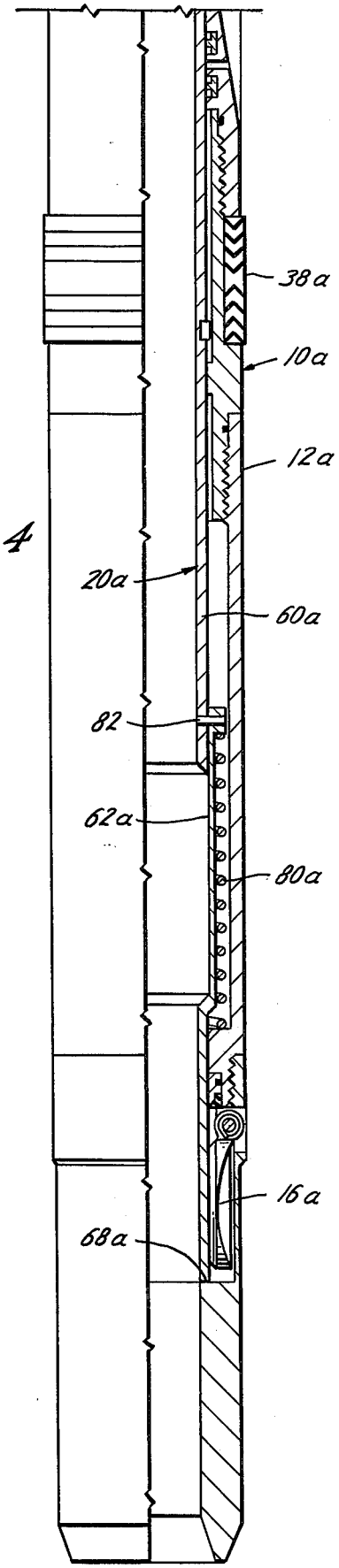

SURFACE CONTROL WELL SAFETY VALVE

BACKGROUND OF THE INVENTION

Generally, it is old to provide a well safety valve, such as shown in U.S. Pat. No. 3,782,461 which generally controls the fluid flow in a well conduit by means of a valve which is movable between an open and closed position in which means are provided to move the valve towards a normally closed position, and a control pressure is exerted from the well surface to move the valve towards an open position. However, in some instances it is desirable to close the safety valve when the fluid control pressure exceeds a preset value. This feature of closing on abnormally high control pressure is particularly advantageous if the annulus formed by the well tubing outside diameter and the casing internal diameter serves as the conductor for the control fluid. For example, a tubing leak into this annular space could cause a high pressure to be exerted onto the safety valve to maintain it in the open position and prevent it from closing.

SUMMARY

The present invention is directed to an improved well safety valve for controlling the flow through a well conduit in which means are provided to move the valve towards a closed position, and fluid control means extending from the well surface acts to move the valve towards an open position in which the valve may operate in its normal mode, but closes when the fluid control pressure exceeds a predetermined value.

A still further object of the present invention is the provision of a well safety valve in which a longitudinally movable tubular member controls the movement of a valve closure member in which the tubular member includes a first upper and a second lower telescoping section with releasable locking means normally securing the telescoping sections together. Means are provided for moving the second telescoping section in a direction for actuating the closure of the valve member when the locking means is released.

Yet a still further object of the present invention is the provision of a stop shoulder in the path of movement of the second telescoping section in the opening direction for actuating the release of the locking means when the force of the control fluid exceeds a predetermined value.

Yet a still further object is the provision of a locking means which is a shear pin which requires that the valve be retrieved after being actuated to a closed position by a predetermined high value of control pressure. In addition, another embodiment of the present invention utilizes a releasable locking means that is resettable after being actuated by a predetermined high control fluid pressure.

Still a further object of the present invention is the provision of a well safety valve in which the valve closure member is a flapper valve through which the lower telescoping section moves for actuating the flapper between an open and closed position in which the lower telescoping section is released from the upper telescoping section upon a predetermined fluid control pressure and moves upwardly to close the flapper valve.

Other and further objects, features and advantages will be readily apparent from the following description of presently preferred embodiments of the invention, given for the purpose of disclosure and taken in conjunction with the accompanying drawings.

BRIEF DESCRIPTION OF THE DRAWINGS

FIG. 3 is a fragmentary, elevational view, partly in cross section, of the portion of the valve shown in FIG. 2C but in the closed position, and FIG. 4 is a fragmentary elevational view, partly in cross section, of another embodiment of the present invention.

DESCRIPTION OF THE PREFERRED EMBODIMENT

While the present improvement in a surface control well safety valve will be shown, for purposes of illustration only, as incorporated in a flapper-type well safety valve installed in a mandrel and responsive to annulus pressure, it will be understood that the present invention may be used in other types of well safety valves and in other types of installations.

Figure 2A:
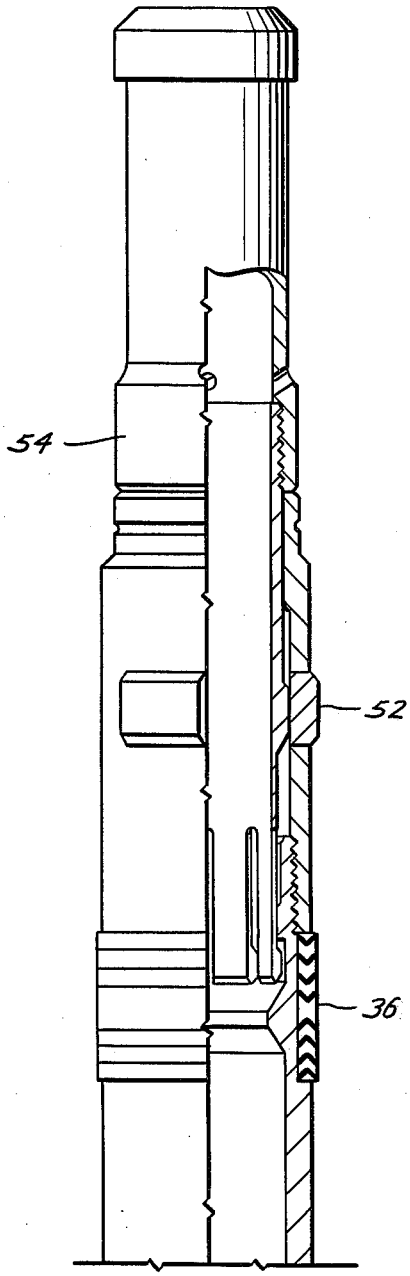
FIGS. 2A, 2B, and 2C are continuations of each other of one form of the safety valve of the present invention, shown in elevational view, and partly in cross section, with the safety valve in the open position.
Figure 2B:
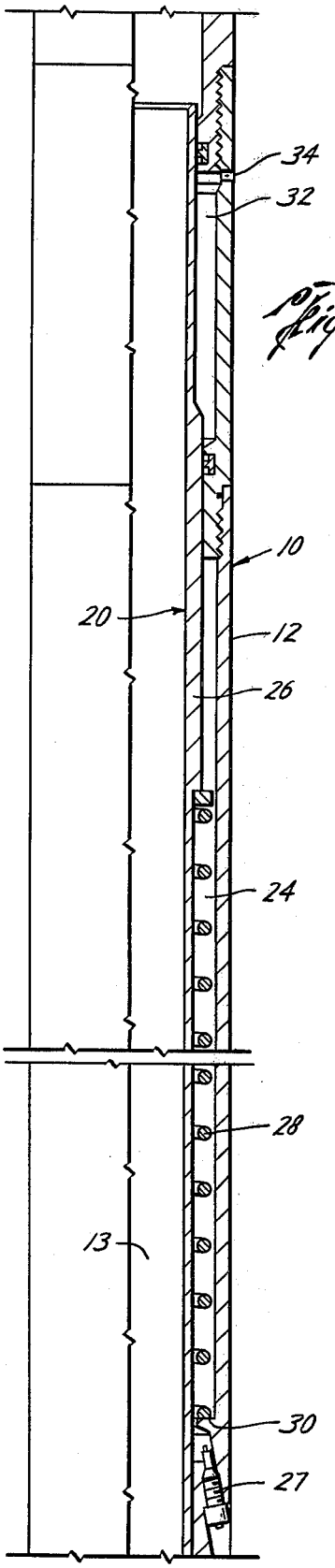
Figure 2C:
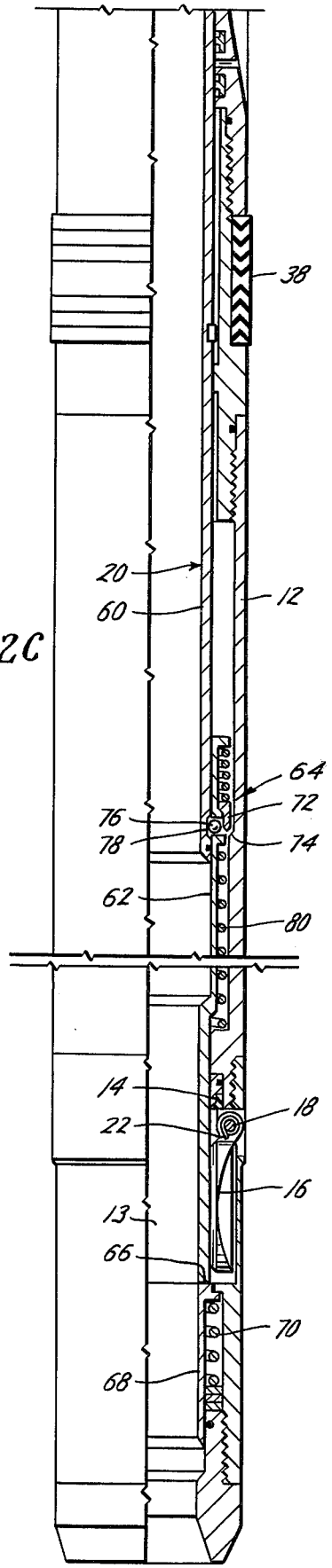

Referring now to the drawings, and particularly to FIGS. 2A, 2B and 2C, one type of subsurface safety valve is shown utilizing the present invention generally indicated by the reference numeral 10. The apparatus 10 generally includes a body 12 adapted to be positioned in a well conduit such as an oil and/or gas well tubing to permit production therethrough under normal operating conditions but in which the valve 10 may be closed in response to an increase in fluid control pressure from the well surface.

The safety valve 12 generally includes an annular valve seat 14 therein (FIG. 2C) and a flapper 16 connected to the body 12 by a pivot pin 18. Thus when the flapper 16 is in the upper position seated on the valve seat 14, the safety valve 10 is closed blocking flow upwardly therethrough. A sliding tube or tubular member generally indicated by the reference numeral 20 is telescopically movable in the body 12 and through the valve seat 14. When the member 20 is moved to a downward position, the member 20 pushes the flapper 16 away from the valve seat 14. The valve is held in the open position so long as the sliding tube 20 is in the downward position. When the sliding tube 20 is moved upwardly, the flapper 16 is allowed to move upwardly closing the valve by the action of a spring 22 and also by the action of fluid flow moving upwardly through the bore 13 of the body 12.

Various forces may be provided to act on the sliding tubular member 20 to control its movement so that under normal operating conditions the sliding member 20 will be in the downward position holding the flapper 16 away of and off of the valve seat 14 and the valve 10 will be open. When abnormal conditions occur, the sliding tube 20 will be moved upwardly allowing the flapper 16 to close shutting off flow through the well conduit. Thus, a chamber 24 may be provided between the member 20 and the body 12 and a piston 26 is secured to or is part of the member 20 in the chamber 24. The chamber 24 below the piston 26 may be pressurized to a desired pressure through a dill valve 27. Thus, pressure in the pressurized chamber 24 acts against the bottom of the piston 26 in a direction to move the sliding tube 20 upwardly to allow the flapper 16 to close and seat on the seat 14. In addition, this closing force may be assisted by providing a spring 28 in the chamber 24 which acts between a shoulder 30 on the body 12 and on the bottom of the piston 26.

The safety valve 10 is controlled by the application or removal of fluid pressure through ports 34 into a chamber 32 against the top of the piston 26 acting in opposition to the force of the pressure in chamber 24 in the spring 28. Thus, if fluid pressure applied through the ports 34 is of sufficient magnitude, the piston 26 and thus the member 20 will be moved downwardly forcing the flapper 16 off of the seat 14 and into full open position. If the pressure applied through ports 34 to the chamber 32 above the piston 26 is reduced sufficiently relatively to the forces on the piston 26 caused by the pressurized chamber 24 and the spring 28, the piston 26 will move upwardly carrying the member 20 upwardly beyond the seat 14 allowing the flapper 16 to swing and close on the seat 14. The pressurized charge in the chamber 24 and the force of the spring 28 may be selected and set so that the safety valve 10 will open and close as desired.

Figure 1:
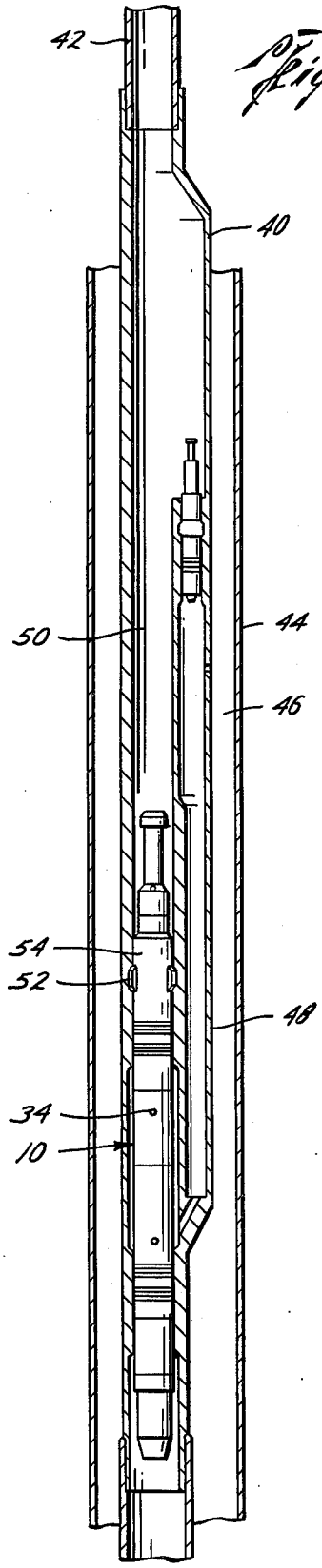
FIG. 1 is an elevational drawing, partly in cross section, illustrating the present invention in use in one type of well installation having a mandrel in a well tubing in which the safety valve is responsive to the annulus pressure.

The safety valve 10 includes an upper seal 36 and a lower seal 38 about the exterior of the body 12 for sealing in the well conduit and receiving the control fluid pressure therebetween such as shown in FIG. 1. As seen in FIG. 1, the safety valve 10 of the present invention may be used in a mandrel 40 positioned in a well conduit or well tubing 42 in a well casing 44. In this installation, the fluid control pressure in the annulus 46 between the exterior of the well tubing 42 and the interior of the casing 44 may flow into the sidepocket 48 of the mandrel 40 and be applied to the safety valve 10 of the present invention between the upper and lower seals 36 and 38. The safety valve 10 is retrievably positioned in the main bore 50 of the mandrel 40 by retractible dogs 52 of a conventional well lock 54.

The above structure and operation is generally described in U.S. Pat. No. 3,782,461. The improved safety valve 10 of the present invention operates as previously described in its normal mode of opening and closing, but also allows the valve 10 to close when the fluid control pressure or force exceeds a predetermined value. This feature of closing on abnormally high control pressures is particularly advantageous in the installation shown in FIG. 1 in which the annulus 46 from the well surface serves as the conductor for the control fluid in communication with the ports 34. For example, a tubing leak through the tubing 42 into the annular space 46 can exert an abnormally high fluid control pressure to the ports 34 holding the valve 10 in an open position. This is particularly true if there is liquid in the annulus 46 providing a high hydrostatic head and high pressure gas leaks into the annular space 46 and exerts its pressure on top of a heavy liquid column. In such an event, the safety valve would be held in the open position and is likely to fail to timely respond to a closing signal from the well surface. The present safety valve 10 allows the safety valve 10 to operate in its normal mode, but causes the valve 10 to close when the fluid control pressure or force reaches a predetermined high or low value.

Referring now to FIGS. 2C and 3, the sliding tubular member 20 includes a first upper section 60 and a second lower 62 telescoping section. The first section 60 and the second section 62 are normally connected together with a releasable locking means generally indicated by the reference numeral 64 so that in normal operation the sliding tube 20 acts as a unitary tubular member. When the valve 10 is normally fully opened, as best seen in FIG. 2C, the bottom of the lower tubular section 62 contacts and stops against a stop shoulder 66 of a movable sleeve 68. The sleeve 68 is yieldably urged upwardly by a spring 70 with a preset load of a predetermined magnitude. When the fluid control force or pressure in excess of the normal operating pressure and above a predetermined value acts against the piston 26 through the ports 34 to move the member 20 downwardly the preset load in the spring 70 will be overcome and allow further downward movement of the tubular member 20. When excess fluid control pressure is exerted on the safety valve 10, the releasable locking means 64 between the tubing section 60 and the tubing section 62 will release. That is, a ball sleeve 72 will contact a releasing shoulder 74 on the body 12 allowing the upper section 60 and the lower section 62 to move downwardly and the locking balls 76 to move down and out from under the ball sleeve 74. When this occurs, the balls 76 move out and disengage the locking groove 78 in the upper tubular section 60. And at this time the lower tubular section 62 is disengaged from the upper tubular section 60 and means for moving the lower tubular section 62, such as a spring 80, will move the lower tubular section 62 upwardly allowing the flapper valve 16 to swing closed and shut off the safety valve 10. Thus, as shown in FIG. 3, the safety valve 10 illustrated in FIGS. 2A, 2B and 2C is automatically closed upon the occurrence of a fluid control pressure that exceeds a predetermined value.

The releasable locking means 64 is also resettable to reconnect the upper tubular sections 60 and lower tubular sections 62 to the position shown in FIG. 2C. This is done by bleeding down the fluid control pressure, such as the annulus 46 in FIG. 1, and in so doing the upper tubular sections 60 will move upwardly by the action of the pressure in chamber 24 and the spring 28 until the locking groove 78 is reengaged by the locking balls 76. The safety valve 10 will then operate in its normal mode, but will close again on the occurrence of an abnormally high control fluid pressure.

Referring now to FIG. 4, another embodiment of the present invention is shown wherein like parts to those of FIG. 3 are shown with identical numbers with the addition of the suffix "a". The remainder of the safety valve 10*a* of FIG. 4 is identical to those shown in FIGS. 2B and 2C. In the embodiment of FIG. 4, the releasable locking means between the first upper tubular section 60*a* and the second lower tubular section 62*a* is one or more shear pins 82. In normal operation of the safety valve 10*a*, the lower end of the lower section 62*a* rests against a fixed stop shoulder 66*a*. However, upon the occurrence of a fluid control force or pressure applied to the safety valve 10*a* in excess of a predetermined value, the tubular member 20*a* will be actuated downwardly against the stop 66*a* shearing the pins 82 after which the spring 80*a* will move the lower tubular member 62*a* upwardly allowing the flapper valve 60*a* to close and shut off flow through the safety valve 10*a*. High closing pressure would be set by the selection of a size, number and material for the shear pins 82. The embodiment of FIG. 4 requires that the valve 10*a* be retrieved after being actuated on the occurrence of an undesirably high fluid control pressure as the releasable locking means 82 is not resettable.

The present invention, therefore, is well adapted to carry out the objects and attain the ends and advantages mentioned as well as others inherent therein. While presently preferred embodiments of the invention have been given for the purpose of disclosure, numerous changes in the details of construction and arrangement of parts may be provided, without departing from the spirit of the invention and the scope of the appended claims.

What is claimed is:

1. In a well safety valve for controlling the fluid flow through a well tubing, the valve adapted to be positioned in the well tubing and having a valve closure member moving between open and closed positions, a longitudinally movable tubular member for controlling the movement of the valve closure member, first means for moving the tubular member in a first direction, second means for moving the tubular member in a second direction, the improvement comprising, said tubular member including a first upper and a second lower telescoping section, releasable locking means normally securing the telescoping sections together and releasable upon a predetermined opening force while the valve is in the open position, and means for moving the second telescoping section relative to the valve closure member in a direction for actuating the closure of the valve member when the locking means is released.

2. The apparatus of claim 1 wherein the releasable locking means is a shear pin.

3. The apparatus of claim 2 including, a stop shoulder in the path of movement of the second lower telescoping section in a direction for opening the valve member for actuating the release of the shear pin.

4. The apparatus of claim 1 including, said releasable locking means being resettable, a releasing shoulder connected to the valve and positioned in the path of movement of the releasable locking means for releasing the locking means when the locking means contacts the releasing shoulder, a stop shoulder in the path of movement of the second lower telescoping section in a direction for opening the valve member, means yieldably urging said stop shoulder in a direction toward said second section, but allowing movement of the second section toward the stop shoulder upon a predetermined force for causing release of the releasing locking means.

5. In a well safety valve for controlling the fluid flow through a well tubing, the valve adapted to be positioned in the well tubing and having a valve closure member moving between open and closed positions, a longitudinally movable tubular member for controlling the movement of the valve closure member, first means for moving the tubular member in a first direction for actuating the closure of the valve member, second fluid means extending outside of the well tubing to the well surface for moving the tubular member in a second direction for opening the valve member, the improvement of means for closing said valve member when the force of said fluid means exceeds a predetermined value comprising, said tubular member including a first upper and a second lower telescoping section, releasable locking means normally securing the telescoping sections together, a stop shoulder in the path of movement of the second section in said second direction for actuating the release of the locking means when the fluid force exceeds said predetermined value and said valve is in the open position, and means for moving the second telescoping section in said first direction for actuating the closure of the valve member when the locking means is released.

6. The apparatus of claim 5 wherein the releasable locking means is a shear pin.

7. The apparatus of claim 5 wherein the valve closure member is a flapper valve through which the movable tubular member moves for actuating the flapper.

8. The apparatus of claim 5 including, said releasable locking means being resettable, a releasing shoulder connected to the valve and positioned in the path of movement of the releasable locking means for releasing the locking means when the locking means contacts the releasing shoulder, and means yieldably urging said stop shoulder in the first direction, but allowing movement of the second section in said second direction when the fluid force exceeds said predetermined value for causing release of the releasing locking means.

9. In a well safety valve for controlling the fluid flow through a well tubing, the valve adopted to be positioned in the well tubing and having a valve closure member moving between open and closed positions, a longitudinally movable tubular member for controlling the movement of the valve closure member, first means for moving the tubular member in a first direction for actuating the closure of the valve member, second fluid means extending outside of the well tubing to the well surface for moving the tubular member in a second direction for opening the valve member, the improvement of means for closing said valve member when the force of said fluid means exceeds a predetermined value comprising, said tubular member including a first upper and a second lower telescoping section, releasable locking means normally securing a telescoping sections together and releasable when the fluid force exceeds said predetermined value and said valve is in the open position, and spring means for moving the second telescoping section relative to the valve closure member in said first direction for actuating the closure of the valve member when the locking means is released.

* * * * *